US006484417B2

(12) United States Patent
Tedman et al.

(10) Patent No.: US 6,484,417 B2
(45) Date of Patent: Nov. 26, 2002

(54) DRYER APPARATUS AND DRYER CONTROL SYSTEM

(75) Inventors: Paul Tedman, Sabetha, KS (US); Douglas Clark, Sabetha, KS (US)

(73) Assignee: Wenger Manufacturing, Inc., Sabetha, KS (US)

( * ) Notice: Subject to any disclaimer, the term of this patent is extended or adjusted under 35 U.S.C. 154(b) by 21 days.

(21) Appl. No.: 09/775,483

(22) Filed: Feb. 2, 2001

(65) Prior Publication Data

US 2002/0152634 A1 Oct. 24, 2002

(51) Int. Cl.[7] ..... F26B 3/00

(52) U.S. Cl. ..... 34/474; 34/446; 34/475; 34/477; 34/557; 34/131; 34/219

(58) Field of Search ..... 34/444, 445, 446, 34/474, 475, 476, 477, 478, 479, 557, 131, 218, 219

(56) References Cited

U.S. PATENT DOCUMENTS

| | | | | |
|---|---|---|---|---|
| 1,564,566 A | | 12/1925 | Harris | |
| 2,448,144 A | | 8/1948 | Guthier | |
| 3,401,530 A | * | 9/1968 | Meckler | 62/2 |
| 3,728,797 A | * | 4/1973 | Worden et al. | 34/32 |
| 4,513,759 A | | 4/1985 | Wochnowski et al. | |
| 4,599,808 A | * | 7/1986 | Gelineau | 34/27 |
| 5,347,727 A | | 9/1994 | Kim | |
| 5,456,025 A | * | 10/1995 | Joiner et al. | 34/528 |
| 5,647,141 A | * | 7/1997 | Hanaya | 34/115 |
| 5,813,135 A | * | 9/1998 | Michie et al. | 34/381 |
| 5,950,325 A | | 9/1999 | Mehdizadeh et al. | |
| 6,085,443 A | | 7/2000 | Hunter et al. | |

FOREIGN PATENT DOCUMENTS

EP 0766050 A2 * 7/1995 ..... F24F/3/14

OTHER PUBLICATIONS

Miller et al.; Drying as a Unit Operation in the Processing of Ready–to–Eat Breakfast Cereals: I. Basic Principles; Cereal Foods World; Mar. 1988, vol. 33, No. 3; pp. 267–277.

Zagorzycki et al.; Automatic Humidty Control of Dryers; CEP; Apr. 1983; pp. 66–70.

* cited by examiner

*Primary Examiner*—Denise L. Esquivel
*Assistant Examiner*—K. B. Rinehart
(74) *Attorney, Agent, or Firm*—Hovey Williams LLP

(57) ABSTRACT

An improved dryer (10) and drying methods are provided which increase overall dryer efficiency by maintaining substantially constant output air stream adiabatic saturation ratio and temperature values during the course of drying, notwithstanding the occurrence of upset conditions. The dryer (10) includes a dryer body (12), an input air heater assembly (14) including an air heater (32), and a control assembly (18). The dryer body (12) has a drying zone (30), with product inputs and outputs (20, 22) as well as an input (26) for a heated air stream and an output (28) for the cooled, moisture-laden output air stream. The dryer control assembly (18) includes temperature and humidity sensors (48, 50) coupled to controllers (54, 60) and a PLC (66). The controller (54) is coupled with an exhaust fan/damper unit (46) while controller (60) is connected with a fuel valve (36). In operation, the temperature and humidity of the output air stream are continuously measured by the sensors (48, 50), and the controllers (54, 60, 66) are operable to adjust the exhaust fan/damper unit (46) to regulate the relative proportion of output air exhausted to the atmosphere and recycled via conduit (52) for mixing with the input air stream, and also regulate the energy input to the dryer. Maintaining a substantially constant output air stream adiabatic saturation ratio and temperature allows dryer operation at significantly higher efficiencies as compared with prior systems.

22 Claims, 1 Drawing Sheet

DRYER APPARATUS AND DRYER CONTROL SYSTEM

BACKGROUND OF THE INVENTION

1. Field of the Invention

The present invention is broadly concerned with improved dryer apparatus and drying methods which maximize dryer efficiency and product exist moisture control, notwithstanding the occurrence of upset conditions such as differences in input air temperature and/or humidity, or the moisture content of incoming product to be dried. More particularly, the invention is concerned with such methods and apparatus wherein the adiabatic saturation ratio (ASR) and the temperature of the output air stream from the dryer are maintained at predetermined, substantially constant levels during drying; such ASR and output air temperature maintenance involves determination of the temperature and humidity of the output air stream and adjustment of recycle and exhaust portions of the output air stream and energy input to the dryer, to maintain the ASR and output air stream temperature.

2. Description of the Prior Art

A variety of continuous dryers have been proposed in the past for drying of agricultural products or processed pellets (e.g., feed pellets). Such dryers include rotary drum dryers, single or multiple-stage conveyor dryers, and staged, vertical, cascade-type dryers. In all such dryers, an initially wet product is contacted with an incoming heated air stream in order to reduce the moisture level of the product; as a consequence, the dryers emit a cooled, moisture-laden output air stream.

Regardless of the type of dryer selected for a particular application, operators are always interested in maximizing drying efficiency, i.e., obtaining the maximum drying effect per pound of fuel consumed. A variety of control systems have been suggested in the past for this purpose. See, e.g., U.S. Pat. Nos. 1,564,566, 2,448,144, 4,513,759, 5,950,325, 5,347,727 and 6,085,443; Zagorzycki, Automatic Humidity Control of Dryers; *Chemical Engineering Progress*, April, 1983, and Miller, Drying as a Unit Operation in the Processing of Ready-to-Eat Breakfast Cereals:I. Basic Principles and Drying as a Unit Operation in the Processing of Ready-to-Eat Breakfast Cereals:II. Selecting a Dryer; *Cereal Foods World*, 33:267–277 (1988). However, the problem of maintaining maximum dryer efficiency while controlling product exit moisture, during the course of a dryer run, which commonly may experience upsets, has not heretofore been satisfactorily resolved.

A known drying parameter is the adiabatic saturation ratio of an air stream, typically the exhaust air stream from a dryer. The ASR is the ratio of air moisture in a given air stream, divided by the saturated air moisture at the same enthalpy. It is usually expressed as a percent, even though referred to as a ratio. An equivalent definition of ASR is the degree of saturation of an air stream when holding enthalpy constant. The humidity ratio for the air stream is divided by the humidity ratio at the intersection of the total enthalpy curve with the saturation curve, using appropriate psychrometric data.

SUMMARY OF THE INVENTION

The present invention overcomes the problems outlined above and provides greatly improved drying methods and apparatus which are capable of maintaining high dryer efficiency notwithstanding the occurrence of upsets. Broadly speaking, the drying methods of the invention involve provision of a stream of input air having initial temperature and humidity levels, heating such input air stream to a desired temperature and contacting the heated air stream with an initially wet product in a drying zone to give a dried product and an output air stream. Control of the process is obtained by determining the temperature and humidity of the output air stream on a continuous basis, and using such information to maintain the adiabatic saturation ratio and the temperature of the output air stream at predetermined, substantially constant levels during the drying process, notwithstanding changes in one or more dryer parameters such as input air temperature and/or humidity levels, initially wet product moisture level and combinations thereof. In practice, maintenance of the adiabatic saturation ratio involves recycling a first portion of the output air stream back to the input air stream for mixing therewith, and exhausting a second portion of the output air stream to the atmosphere, in response to the determination of output air stream temperature and humidity. Additionally, the control typically involves adjusting the energy input to the dryer; in most cases, such energy input adjustment includes regulation of the temperature of the heated input air stream, but other energy inputs to the dryer, if any, may also be regulated.

The invention is applicable to virtually all types of convection dryers where a wet product and a heated air stream are contacted for drying purposes. This includes but is not limited to rotary, conveyor, cascade-type, fluid bed and counterflow dryers. To this end, the dryers may incorporate indirect or direct heating of the input air stream; in the latter case, the effects of direct combustion must of course be taken into consideration.

In preferred practice, the dryer is equipped with an exhaust fan/damper unit which serves to draw output air from the drying zone. The control apparatus is coupled with the damper so as to continually adjust as necessary the relative proportions of the output air stream which are recycled and exhausted to the atmosphere. Alternately, in lieu of an exhaust fan/damper unit, a variable speed exhaust fan can be employed. Conventional programmable logic controllers are used in such preferred systems to regulate dryer operation so as to maintain substantially constant ASR and output air stream temperatures.

DETAILED DESCRIPTION OF THE PREFERRED EMBODIMENT

Figure 1:
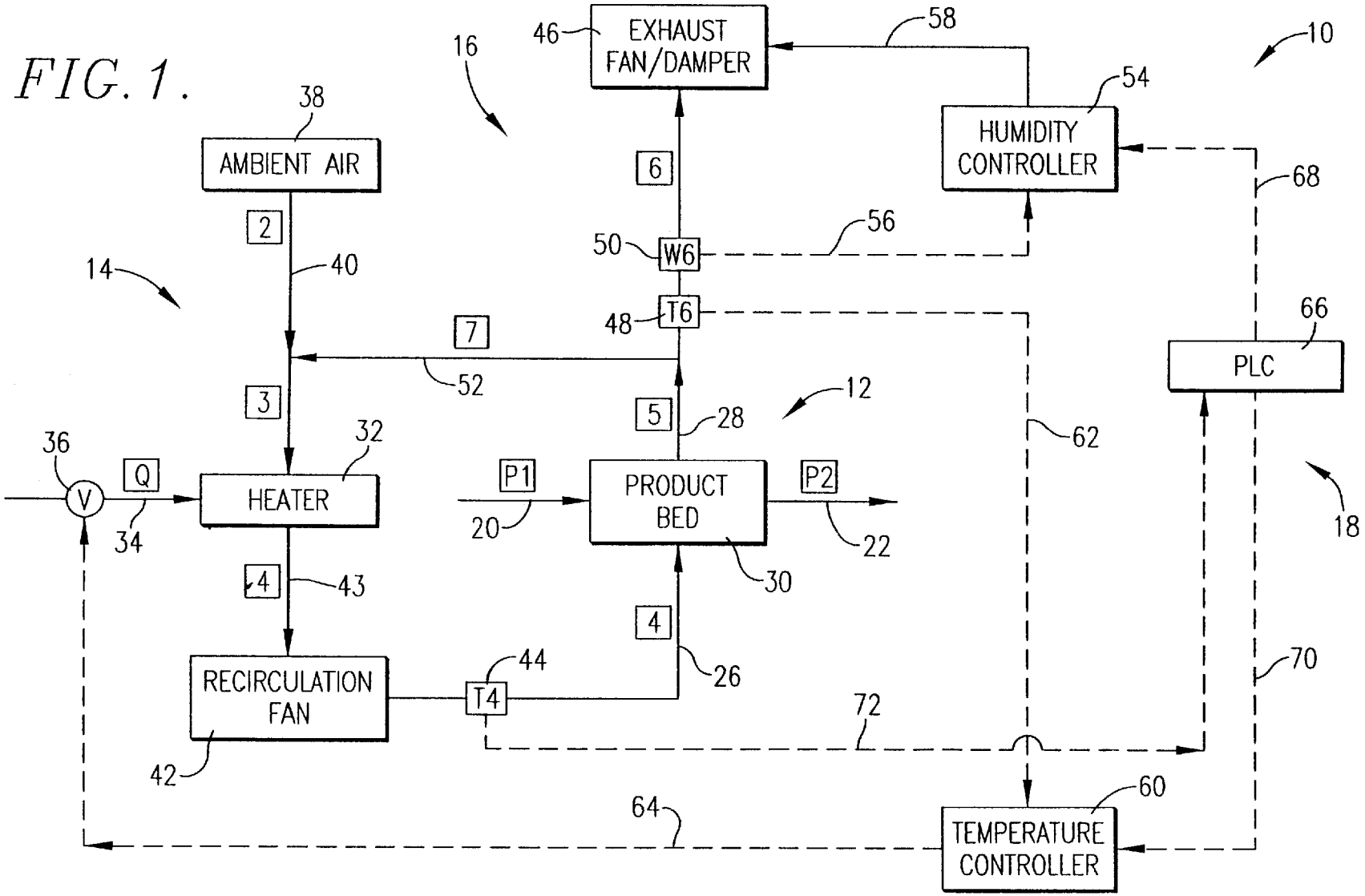
FIG. 1 is a schematic representation of a preferred dryer in accordance with the invention.

Turning now to the drawing, a dryer 10 in accordance with the invention broadly includes a dryer body 12 adapted to receive and dry initially wet product, with an input air heater assembly 14, output air handling assembly 16 and control assembly 18 coupled to the dryer body.

The dryer body 12 is schematically illustrated in the Figure, and includes a wet product inlet 20 and a dried product outlet 22, as well as a heated air input line 26 and an air output line 28. It will be understood that the body 12 can take the form of a wide variety of known dryers, such as rotary drum dryers, single or multiple-stage conveyor dryers or staged, vertical cascade-type dryers such as those disclosed in pending U.S. patent application Ser. No. 09/543,596 filed Apr. 5, 2000, incorporated by reference herein. In each case, the body 12 defines an internal drying zone 30 designed for contacting a heated input air stream and initially wet product.

The input air heater assembly 14 includes a heater 32 having a fuel inlet line 34 coupled thereto, the latter being controlled by valve 36. In addition, the assembly 14 includes an ambient air intake 38 and input line 40 for delivering a stream of input air to the heater 32. The overall assembly further includes a recirculation fan 42 coupled with heater output 43 and line 26 as shown. A temperature sensor 44 is operatively coupled with line 26. The heater 32 in the embodiment shown is an indirect heater, but if desired a direct heater could be used.

The output air handling assembly 16 includes an exhaust fan/damper unit 46 made up of a conventional exhaust fan together with a selectively movable damper. The line 28 extends from dryer body 12 to the inlet of the unit 46, and has temperature and humidity sensors 48, 50 coupled thereto. Finally, a recycle line 52 is coupled between the lines 28 and 40 for purposes to be explained.

The control assembly 18 includes a humidity controller 54 with an input line 56 from sensor 50, and an output line 58 to exhaust fan/damper unit 46. Also, the assembly has a temperature controller 60 with an input line 62 from sensor 48 and an output line 64 leading to valve 36. A programmable logic controller 66 is operatively coupled to the controllers 54 and 60 via lines 68 and 70. Finally, a line 72 extends between temperature sensor 44 and PLC 66.

In the use of dryer 10, a stream of input air having input temperature and humidity levels is generated at intake 38 and passed through input line 40 to heater 32. At the same time, fuel is directed through inlet line 34 to the heater. Combustion within the heater 32 serves to heat the input air stream to a desired temperature. The fan 42 draws the heated input air stream through lines 43 and 26 in order to deliver such air to dryer 12. The temperature of the heated input air stream is measured by sensor 44. Initially wet product is delivered to the dryer via input 20 and, within the drying zone 30 the initially wet product is dried, leaving by way of output 22. The output air stream from the dryer body 12 is conveyed by means of exhaust fan/damper unit 46 through line 28, with the temperature and humidity thereof being determined by sensors 48 and 50. Depending upon the position of the damper within unit 46 (or alternately the speed of the exhaust fan), first and second portions of the output air stream are recycled through line 52 and exhausted to the atmosphere. The recycled output air is mixed with the input air stream and reheated in heater 32.

During operation of the dryer 10 as described, the control assembly 18 comes into play in order to maintain the adiabatic saturation ratio (ASR) and the temperature of the output air stream at predetermined, substantially constant levels. This result obtains notwithstanding dryer system upsets such as caused by changes in a parameter selected from the group consisting of the temperature and/or humidity of the input air at intake 38, the initially wet product moisture level (which can occur by a wetter starting product or an increase in the flow rate of wet product through dryer body 12), and combinations thereof. In particular, the control assembly 18 preferably serves to maintain the ASR within the range of about ±2 ASR percentage points (e. g., if the predetermined ASR is 90%, the maintenance should be from about 88% to 92%); more preferably, this range should be about ±0.5 ASR percentage points. In the case of output air temperature, the assembly 18 should maintain the temperature within the range of from about ±10% of the predetermined temperature, more preferably from about ±2%.

Assuming a constant ASR, T6 controls the moisture level of the dried product. Thus, an increase in T6 will lower the dried product moisture and vice-versa. In practice, an operator will initially experimentally determine the value of T6 that gives the desired product moisture content, and thus T6 will then become the set point value.

The control assembly 18 performs these functions by two primary system adjustments, namely an adjustment of the exhaust fan/damper unit 46 to alter the relative proportions of the output air stream which are recycled via line 52 and exhausted to the atmosphere, and adjusting the energy input to the dryer by controlling fuel to the heater 32 using valve 36. The connection between sensor 44 and PLC 66 is a protective measure; if the sensor 44 detects an unacceptably high or low temperature, the PLC will shut down the entire system or permit the operator to lower the temperature through operation of valve 36.

For example, if the dryer 10 is operating in steady state conditions and the water content of the product to be dried is lowered (or a lower flow rate of the moist product occurs), the assembly 18 would typically reduce the heat input to the system by adjusting valve 36, and also adjust exhaust fan/damper unit 46 so as to exhaust to the atmosphere a smaller proportion of the output air stream (which therefore increases the proportion of the output air stream recycled through line 52). Such adjustments are carried out until the predetermined ASR and output air stream temperatures are again substantially returned to their predetermined levels. Alternately, if the water content of the incoming product is increased (or a higher flow rate occurs), more heat would be added and a greater proportion of the output air stream would be exhausted to the atmosphere.

Control of the ASR and output air stream temperature leads to greater dryer efficiencies. Generally speaking, for most dryers the predetermined ASR level should be in the range of from about 80–95%, more preferably from about 88–92%. Of course the output air stream temperature is extremely variable, depending upon the type of product being dried and desired final product moisture levels.

As explained above, ASR is a description of the extent of saturation of air, and is directly related to overall energy efficiency (a higher ASR means a higher energy efficiency). As the output air is exhausted from the dryer it will lose heat in the ducting. This is an undesirable condition. Therefore, the operator will set the ASR low enough to avoid condensation in the dryer ducting during normal operating conditions, but otherwise as high as possible in order to maximize dryer efficiency. The advantage of using ASR as a primary control variable stems from the fact that dryer efficiency will remain essentially constant as long as the ASR is unchanged, regardless of what other variables may change.

The following hypothetical examples set forth exemplary dryer operating conditions at steady state and these operating conditions after four different types of system upsets have been accommodated and the dryer is again at steady state. It is to be understood, however, that these examples are provided by way of illustration and nothing therein should be taken as a limitation upon the overall scope of the invention.

EXAMPLE

The following Table 1 sets forth a series of computer-generated mass and energy balances for a dryer in accordance with the invention and as depicted in FIG. 1. In all of the upset cases 1–5 the mass and energy balances are taken after the control assembly 18 has reacted to the upset and returned the dryer to steady state conditions. In this Example, the ASR is selected as 90%, and the output air stream temperature measured by the sensor 48 (position 6) is 80° C. In FIG. 1, the boxed numerals and letters refer to the discrete positions within the dryer system, whereas the legends T4, T6 and W6 refer to sensors as described previously.

In particular, the initial or start case is varied by lowering the moisture content of the incoming product from 0.23 to 0.22 kg $H_2O$/kg product (Case 1); the moisture content of the incoming product is raised from 0.23 to 0.24 kg $H_2O$/kg product (Case 2); the temperature of the input air stream at intake 38 is elevated from 21° to 35° C. (Case 3); the absolute humidity of the input air stream at intake 38 is elevated from 0.0080 to 0.0170 kg $H_2O$/kg air (Case 4); and the moisture content of the incoming product is raised from 0.23 to 0.24 kg $H_2O$/kg product, together with elevation of the temperature and absolute humidity of the input air stream at intake 38 to 35° C. and 0.0170 kg $H_2O$/kg air, respectively (Case 5).

As can be seen from Table 1, in each case the control assembly 18 serves to return the dryer to the desired 90% ASR, 80° C. output air stream temperature by appropriate adjustment of the heat input to the system via heater 32 and/or the ratio of exhausted to recycled output air from the dryer body 12. Thus, in Case 1, the adjustment results in changes in the calculated values for GDP1, GDP2, GP2, CP1, GWP1, GPW2, HP1, HP2, GD6, C6, GW6, GW2, GD2, H6, H2, Q, Eff, GD2, W4, GD4, GD5, H5, H4, T4, and V4. This stems from the fact that, in returning to the steady state condition with predetermined ASR and output air stream temperatures, less input heat is delivered to heater 32 (position Q) resulting in a lower temperature T4 (position 4).

In a similar fashion, the remaining upset cases can be analyzed to ascertain the alterations effected by the control assembly 18, as set forth in Table 1.

TABLE 1

MASS & ENERGY BALANCES

| | | INITIAL start | CASE 1 less water | CASE 2 more water | CASE 3 hotter amb | CASE 4 wetter amb | CASE 5 combination |
|---|---|---|---|---|---|---|---|
| GIVEN (either outside variables or control variables) | | | | | | | |
| GP1 | kg/hr | 12,000 | 12,000 | 12,000 | 12,000 | 12,000 | 12,000 |
| WP1 | kg/kg | 0.23 | 0.22 | 0.24 | 0.23 | 0.23 | 0.24 |
| WP2 | kg/kg | 0.09 | 0.09 | 0.09 | 0.09 | 0.09 | 0.09 |
| TP1 | ° C. | 80 | 80 | 80 | 80 | 80 | 80 |
| TP2 | ° C. | 75 | 75 | 75 | 75 | 75 | 75 |
| T2 | ° C. | 21 | 21 | 21 | 35 | 21 | 35 |
| W2 | kg/kg | 0.0080 | 0.0080 | 0.0080 | 0.0080 | 0.0170 | 0.0170 |
| T6 | ° C. | 80 | 80 | 80 | 80 | 80 | 80 |
| ASR | | 90% | 90% | 90% | 90% | 90% | 90% |
| Z4 | mls | 0.63 | 0.63 | 0.63 | 0.63 | 0.63 | 0.63 |
| AB | $m^2$ | 52 | 52 | 52 | 52 | 52 | 52 |
| C&R | kcal/hr | 80,000 | 80,000 | 80,000 | 70,000 | 80,000 | 70,000 |
| CALCULATED | | | | | | | |
| W6 = f(ASR, T6) | kg/kg | 0.1075 | 0.1075 | 0.1075 | 0.1075 | 0.1075 | 0.1075 |
| GDP1 = GP1*(1-WP1) | kg/hr | 9,240 | 9,360 | 9,120 | 9,240 | 9,240 | 9,120 |
| GDP2 = GDP1 | kg/hr | 9,240 | 9,360 | 9,120 | 9,240 | 9,240 | 9,120 |
| GP2 = GDP2/(1-WP2) | kg/hr | 10,154 | 10,286 | 10,022 | 10,154 | 10,154 | 10,022 |
| CP1 = f(WP1) | kcal/° C./kg | 0.846 | 0.844 | 0.848 | 0.846 | 0.846 | 0.848 |
| CP2 = f(WP2) | kcal/° C./kg | 0.818 | 0.818 | 0.818 | 0.818 | 0818 | 0.818 |
| GWP1 = GP1–GPD1 | kg/hr | 2,760 | 2,640 | 2,880 | 2,760 | 2,760 | 2,880 |
| GPW2 = GP2–GPD2 | kg/hr | 914 | 926 | 902 | 914 | 914 | 902 |
| HP1 = GP1*CP1*TP1 | kcal/hr | 812,160 | 810,240 | 814,080 | 812,160 | 812,160 | 814,080 |
| HP2 = GP2*CP2*TP2 | kcal/hr | 622,938 | 631,029 | 614,848 | 622,938 | 622,938 | 614,848 |
| C4 = Z4*AB | $m^3$/s | 32.5 | 32.5 | 32.5 | 32.5 | 32.5 | 325 |
| h2 = 0.241*T2 + W2*(−589 + 0.45*T2) | kcal/kg | 9.85 | 9.85 | 9.85 | 13.27 | 15.23 | 18.72 |
| V2 = f(T2, W2) | $m^3$/kg | 0.830 | 0.830 | 0.830 | 0.881 | 0.853 | 0.893 |
| V6 = f(T6, W6) | $ft^2$/lb | 0.999 | 0.999 | 0.999 | 0.999 | 0.999 | 0.999 |
| h6 = 0.241*T6 + W6*(−589 + 0.45*t6) | kcal/kg | 86.47 | 86.47 | 86.47 | 86.47 | 6.47 | 86.47 |
| GD6 = (GPW1–GPW2)/(W6–W2) | kg/hr | 18,554 | 17,229 | 19,880 | 18,554 | 20,399 | 21,857 |
| C6 = V6*GD6/3600 | $ft^3$/min | 5.15 | 4.78 | 5.52 | 5.15 | 5.66 | 6.07 |
| GW6 = W6*GD6 | kg/hr | 1,995 | 1,852 | 2,137 | 1,995 | 2,193 | 2,350 |
| GW2 = GW6 + GPW1–GPW2 | kg/hr | 148 | 138 | 159 | 148 | 347 | 372 |
| GD2 = GD6 | kg/hr | 18,554 | 17,229 | 19,880 | 18,554 | 20,399 | 21,857 |
| H6 = GD6*h6 | kcal/hr | 1,604,345 | 1,489,749 | 1,718,941 | 1,604,345 | 1,763,893 | 1,889,885 |
| H2 = GD2*h2 | kcal/hr | 182,734 | 169,682 | 195,786 | 246,271 | 310,779 | 409,063 |
| Q = HP2–HP1 + H6–H2 | kcal/hr | 1,232,389 | 1,140,856 | 1,323,923 | 1,168,852 | 1,263,892 | 1,281,591 |
| Eff = Q/(GPW1–GPW2) | kcal/kg | 668 | 665 | 669 | 633 | 685 | 648 |
| T5 = T6 | ° C. | 80 | 80 | 80 | 80 | 80 | 80 |
| W5 = W6*GD6 | kg/kg | 0.1075 | 0.1075 | 0.1075 | 0.1075 | 0.1075 | 0.1075 |
| h5 = h6 | kcal/kg | 86.47 | 86.47 | 86.47 | 86.47 | 86.47 | 86.47 |
| W7 = W6*GD6 | kg/kg | 0.1075 | 0.1075 | 0.1075 | 0.1075 | 0.1075 | 0.1075 |
| GD2 = GD6 | kg/hr | 18,554 | 17,229 | 19,880 | 18,554 | 20,399 | 21,857 |
| T7 = T6 | ° C. | 80 | 80 | 80 | 80 | 80 | 80 |
| Assume W4[1] | kg/kg | 0.0877 | 0.0892 | 0.0861 | 0.0877 | 0.0877 | 0.0861 |

TABLE 1-continued

| | | | | | | | |
|---|---|---|---|---|---|---|---|
| GD4 = (GPW1–GPW2)/(W5–W4) | kg/hr | 93,146 | 93,677 | 92,431 | 93,240 | 93,240 | 92,431 |
| GD5 = GD4 | kg/hr | 93,146 | 93,677 | 92,431 | 93,240 | 93,240 | 92,431 |
| H5 = GD5*h5 | kcal/hr | 8,054,102 | 8,100,000 | 7,992,272 | 8,062,238 | 8,062,238 | 7,992,272 |
| H4 = H5 + HP2–HP1 | kcal/hr | 7,864,881 | 7,920,789 | 7,793,040 | 7,873,016 | 7,873,016 | 7,793,040 |
| T4 = (H4/GD4 − 589*W4)/(0.241 + 0.45*W4) | ° C. | 116.9 | 113.9 | 120.1 | 116.9 | 116.9 | 120.1 |
| V4 = f(T4, W4) | $m^3$/kg | 1.256 | 1.249 | 1.264 | 1.256 | 1.256 | 1.264 |
| C4 = V4*GD4/3600 | $m^3$/s | 32.5 | 32.5 | 32.5 | 32.5 | 32.5 | 32.5 |
| | | | less heat<br>less exh<br>lower temp<br>same eff | more heat<br>more exh<br>higher temp<br>same eff | less heat<br>same exh<br>same temp<br>better eff | more heat<br>more exh<br>same temp<br>worse eff | more heat<br>more exh<br>higher temp<br>worse eff |

[1]W4 is ascertained by trial and error, until C4 calculated as Z4* AB = C4 calculated as V4*GD4/3600

| VARIABLE | Description |
|---|---|
| AB | Area of product bed [$m^2$] |
| ASR | Adiabatic saturation ratio (see explanation below) |
| C | Volumetric air flow [$m^3$/s] |
| CP | Specific heat of product [kcal/° C./kg] |
| C&R | Convection & radiation losses (kcal/hr) |
| Eff | Energy efficiency (kcal/kg water evaporated) |
| GD | Mass flow of dry air [kg/hr] |
| GP | Total mass flow of product [kg/hr] |
| GDP | Mass flow of bone dry product [kg/hr] |
| GWP | Mass flow of water portion of product [kg/hr] |
| GW | Mass flow of water vapor in air [kg/hr] |
| h | Specific enthalpy of moist air above ° C. [kcal/kg/° C.] |
| H | Total enthalpy of moist air above 0° C. [kcal/hr] |
| Q | Total heat added to dryer [kcal/hr] |
| T | Temperature of air (dry bulb) [° C.] |
| TP | Temperature of product [° C.] |
| W | Absolute humidity (mass of water vapor per unit mass of dry air) [kg/kg] |
| WP | Moisture content of product (wet basis) [kg/kg] |
| V | Specific volume of moist air [$m^3$/kg] |
| Z | Air velocity through bed [m/s] |

As indicated, a goal of the invention is to achieve maximum possible dryer efficiency while controlling product exit moisture. In general, this obtains when the predetermined ASR is from about 80–95%, more preferably from about 88–92%. Table 2below illustrates hypothetical, computer-generated dryer conditions and efficiencies at selected ASR's (88, 90, 92, 94%) and output air stream temperatures T6 (150–210° C.), where the table symbols are explained in the legend below. A review of Table 2confirms that as the ASR is increased, the energy efficiency improves. Moreover, when the ASR is held constant, the efficiency (EFF) varies only slightly with large changes in exhaust air stream temperature (T6). Moreover, efficiencies (Eff) vary slightly with exhaust air stream temperatures (T6), but vary more significantly with small ASR changes.

TABLE 2

RELATIONSHIP BETWEEN ASR AND EFFICIENCY

| ASR | T6 ° F. | Ts6 ° F. | W6 | V6 $ft^3$/lb | h6 Btu/lb | hs6 Btu/lb | dew pt ° F. | T2 ° F. | W2 | GD6 lb/hr | delta GP lb/hr | Q Btu/hr | Eff Btu/lb | to dew Btu/hr | WBD ° F. |
|---|---|---|---|---|---|---|---|---|---|---|---|---|---|---|---|
| 94% | 210 | 153.30 | 0.23224 | 23.12 | 318.97 | 299.37 | 151.48 | 70 | 0.0078 | 15,792 | 3,216 | 3,956,750 | 1,230 | 309,528 | 57 |
| | 200 | 149.70 | 0.20566 | 22.07 | 284.91 | 268.14 | 147.85 | 70 | 0.0078 | 17,920 | 3,216 | 3,971,186 | 1,235 | 300,515 | 50 |
| | 190 | 145.78 | 0.18060 | 21.08 | 252.85 | 238.60 | 143.91 | 70 | 0.0078 | 20,527 | 3,216 | 3,989,679 | 1,241 | 292,517 | 44 |
| | 180 | 141.48 | 0.15697 | 20.15 | 222.64 | 210.64 | 139.60 | 70 | 0.0078 | 23,793 | 3,216 | 4,013,601 | 1,248 | 285,511 | 39 |
| | 170 | 136.77 | 0.13489 | 19.27 | 194.40 | 184.38 | 134.89 | 70 | 0.0078 | 27,946 | 3,216 | 4,043,853 | 1,257 | 280,018 | 33 |
| | 160 | 131.67 | 0.11467 | 18.46 | 168.48 | 160.19 | 129.79 | 70 | 0.0078 | 33,261 | 3,216 | 4,079,883 | 1,269 | 275,736 | 28 |
| | 150 | 126.10 | 0.09613 | 17.71 | 144.64 | 137.84 | 124.23 | 70 | 0.0078 | 40,284 | 3,216 | 4,124,049 | 1,282 | 273,932 | 24 |
| 92% | 210 | 147.55 | 0.18744 | 21.92 | 267.20 | 246.88 | 145.07 | 70 | 0.0078 | 19,801 | 3,216 | 4,108,510 | 1,278 | 402,352 | 62 |
| | 200 | 144.15 | 0.16764 | 21.06 | 241.15 | 223.48 | 141.66 | 70 | 0.0078 | 22,261 | 3,216 | 4,123,755 | 1,282 | 393,361 | 56 |
| | 190 | 140.43 | 0.14857 | 20.24 | 216.13 | 200.87 | 137.93 | 70 | 0.0078 | 25,289 | 3,216 | 4,144,073 | 1,289 | 385,914 | 50 |
| | 180 | 136.37 | 0.13040 | 19.46 | 192.30 | 179.22 | 133.87 | 70 | 0.0078 | 29,055 | 3,216 | 4,169,937 | 1,297 | 380,036 | 44 |
| | 170 | 131.98 | 0.11340 | 18.73 | 169.96 | 158.86 | 129.49 | 70 | 0.0078 | 33,756 | 3,216 | 4,200,716 | 1,306 | 374,695 | 38 |
| | 160 | 127.21 | 0.09751 | 18.03 | 149.04 | 139.70 | 124.73 | 70 | 0.0078 | 39,770 | 3,216 | 4,237,956 | 1,318 | 371,451 | 33 |
| | 150 | 122.03 | 0.08281 | 17.38 | 129.60 | 121.82 | 119.55 | 70 | 0.0078 | 47,613 | 3,216 | 4,282,192 | 1,332 | 370,427 | 28 |
| 90% | 210 | 142.92 | 0.15761 | 21.11 | 232.72 | 211.80 | 139.79 | 70 | 0.0078 | 23,828 | 3,216 | 4,260,977 | 1,325 | 498,481 | 67 |
| | 200 | 139.32 | 0.14006 | 20.33 | 209.41 | 190.96 | 136.14 | 70 | 0.0078 | 27,008 | 3,216 | 4,290,561 | 1,334 | 498,304 | 61 |
| | 190 | 135.96 | 0.12496 | 19.63 | 189.06 | 172.99 | 132.59 | 70 | 0.0078 | 30,505 | 3,216 | 4,313,198 | 1,341 | 490,220 | 54 |
| | 180 | 131.92 | 0.11059 | 18.95 | 169.68 | 155.69 | 128.75 | 70 | 0.0078 | 34,792 | 3,216 | 4,340,383 | 1,350 | 486,738 | 48 |
| | 170 | 127.75 | 0.09692 | 18.31 | 151.21 | 139.19 | 124.60 | 70 | 0.0078 | 40,159 | 3,216 | 4,373,583 | 1,360 | 482 717 | 42 |
| | 160 | 123.25 | 0.08409 | 17.70 | 133.84 | 123.59 | 120.10 | 70 | 0.0078 | 46,956 | 3,216 | 4,412,475 | 1,372 | 481,295 | 37 |
| | 150 | 118.38 | 0.07213 | 17.12 | 117.54 | 108.90 | 115.29 | 70 | 0.0078 | 55,744 | 3,216 | 4,457,652 | 1,386 | 481,625 | 32 |

TABLE 2-continued

| | | | | | | | | | | | | | | | |
|---|---|---|---|---|---|---|---|---|---|---|---|---|---|---|---|
| 88% | 210 | 138.67 | 0.13412 | 16.98 | 205.58 | 184.09 | 134.83 | 70 | 0.0078 | 28,372 | 3,216 | 4,433,011 | 1,378 | 609,713 | 71 |
| | 200 | 135.48 | 0.12109 | 19.93 | 187.58 | 168.51 | 131.64 | 70 | 0.0078 | 31,650 | 3,216 | 4,453,682 | 1,385 | 603,571 | 65 |
| | 190 | 132.04 | 0.10854 | 19.20 | 170.23 | 153.43 | 128.21 | 70 | 0.0078 | 35,614 | 3,216 | 4,478,840 | 1,393 | 598,314 | 58 |
| | 180 | 128.33 | 0.09650 | 18.59 | 153.59 | 138.89 | 124.52 | 70 | 0.0078 | 40,477 | 3,216 | 4,509,272 | 1,402 | 595,006 | 52 |
| | 170 | 124.35 | 0.08512 | 18.01 | 137.80 | 125.04 | 120.54 | 70 | 0.0078 | 46,471 | 3,216 | 4,543,981 | 1,413 | 592,973 | 46 |
| | 160 | 120.04 | 0.07431 | 17.45 | 122.75 | 111.79 | 116.29 | 70 | 0.0078 | 54,076 | 3,216 | 4,585,408 | 1,426 | 592,673 | 40 |
| | 150 | 115.40 | 0.06419 | 16.92 | 108.59 | 99.25 | 111.72 | 70 | 0.0078 | 63,850 | 3,216 | 4,632,583 | 1,440 | 596,361 | 35 |

| VARIABLE | Description |
|---|---|
| ASR | Adiabatic saturation ratio |
| delta GP | Mass of water evaporated from product [lb/hr] |
| dew pt | dew point (temperature of saturated air) [° F.] |
| Eff | Energy efficiency (Btu/lb water evaporated) |
| GD | Mass flow of dry air [lb/hr] |
| h | Specific enthalpy of moist air above 0° F. [Btu/lb/° F.] |
| H | Total enthalpy of moist air above 0° F. [Btul/hr] |
| hs | Saturation enthalpy of moist air above 0° F. [Btu/lb/° F.] |
| T | Temperature of air (dry bulb) [° F.] |
| to dew | Energy removed from air to lower it to dew point [Btu/hr] |
| Ts | Saturation temperature of air (wet bulb) [° F.] |
| V | Specific volume of moist air [$lb^3$/lb] |
| W | Absolute humidity (mass of water vapor per unit mass of dry air) [lb/lb] |
| WBD | Wet Buld Depression (dry bulb wet bulb) [° F.] |

We claim:

1. A method of drying an initially wet product having a moisture level, comprising the steps of:

providing a stream of input air having input temperature and humidity levels;

heating the input air stream to a desired temperature;

contacting the heated input air stream and said initially wet product in a drying zone to give a dried product and an output air stream;

determining the temperature and humidity of said output air stream; and maintaining the adiabatic saturation ratio and the temperature of said output air stream at predetermined, substantially constant levels during said drying, notwithstanding changes in a parameter selected from the group consisting of said input air temperature level, input air humidity level, said initially wet product moisture level, and combinations thereof, said maintaining step comprising the steps of recycling a first portion of said output air stream back to said input air stream for mixing therewith, exhausting a second portion of said output air stream to the atmosphere, and adjusting the energy input to the dryer, in response to said determining step.

2. The method of claim 1, said maintaining step comprising the steps of altering a condition selected from the group consisting of the temperature of said heated input air stream, the relative proportions of said first and second portions of said output air stream, and combinations thereof.

3. The method of claim 1, said heating step comprising the step of indirectly heating said input air stream.

4. The method of claim 1, said heating step comprising the step of directly heating said input air stream.

5. The method of claim 1, said contacting step being carried out in a dryer selected from the group consisting of rotary, conveyor, cascade, fluid bed and counterflow dryers.

6. The method of claim 1, said recycling and exhausting steps comprising the steps of drawing said output air stream from said drying zone by means of an exhaust fan equipped with a damper, and adjusting said damper to alter the relative proportions of said first and second portions of the output air stream.

7. The method of claim 1, said determining step comprising the steps of drawing said output air stream from said drying zone, and sensing the temperature and humidity levels of the output air stream.

8. The method of claim 1, including the step of maintaining said adiabatic saturation ratio within the range of about ±2 ASR percentage points.

9. The method of claim 8, said range being ±0.5 ASR percentage points.

10. The method of claim 1, including the step of maintaining said output air stream temperature within the range of about ±10% of said predetermined level.

11. The method of claim 10, said range being ±2%.

12. A dryer for drying an initially wet product having a moisture level, comprising:

a dryer body presenting an internal drying zone;

an input air heater operable to heat an input air stream having input air temperature and humidity levels to a desired temperature, and to deliver the heated input air stream to said zone;

an initially wet product input coupled with the dryer in communication with said zone for delivery of initially wet product to the zone, said dryer body operable to contact said heated input air stream and said initially wet product to give a dried product and an output air stream;

an output for said output air stream operatively coupled with said dryer body in communication with said zone in order to convey said output air stream from the zone;

sensor apparatus for determining the temperature and humidity levels of said output air stream;

a recycle conduit operatively coupled between said output air output and said heater; and a controller operable to maintain the adiabatic saturation ratio and the temperature of said output air at predetermined, substantially constant levels during operation of said dryer notwithstanding changes in a parameter selected from the group consisting of said input air temperature, said input air humidity, said initially wet product moisture level and combinations thereof, by recycling a first portion of said output air stream through said recycle conduit and exhausting a second portion of said output air stream to the atmosphere, and adjusting the energy input to the dryer, said controller operable to maintain said adiabatic saturation ratio within the range of about ±2 ASR percentage points.

13. The dryer of claim 12, there being an exhaust fan equipped with a damper operably coupled with said output, said controller coupled with said heater and said damper in order to permit alteration of the temperature of said heated input air stream and/or the relative proportions of said first and second portions of said output air stream.

14. The dryer of claim 12, said controller comprising a humidity controller operably coupled between said humidity level sensor apparatus and said damper, a temperature controller operably coupled between said temperature level sensor apparatus and said heater.

15. The dryer of claim 14, including a temperature sensor for determining the temperature of said heated input air stream.

16. The dryer of claim 12, said sensor apparatus operably coupled with said output for determining the temperature and humidity levels of the output air stream outside of said zone.

17. The dryer of claim 12, said dryer body selected from the group consisting of a dryer selected from the group consisting of rotary, conveyor, cascade, fluid bed and counterflow dryers.

18. The dryer of claim 12, said range being ±0.5 ASR percentage points.

19. The dryer of claim 12, said controller operable to maintain said output air stream temperature within the range of about ±10% of said predetermined level.

20. The dryer of claim 19, said range being ±2%.

21. A dryer for drying an initially wet product having a moisture level, comprising:

a dryer body presenting an internal drying zone;

an input air heater operable to heat an input air stream having input air temperature and humidity levels to a desired temperature, and to deliver the heated input air stream to said zone;

an initially wet product input coupled with the dryer in communication with said zone for delivery of initially wet product to the zone, said dryer body operable to contact said heated input air stream and said initially wet product to give a dried product and an output air stream;

an output for said output air stream operatively coupled with said dryer body in communication with said zone in order to convey said output air stream from the zone;

sensor apparatus for determining the temperature and humidity levels of said output air stream;

a recycle conduit operatively coupled between said output air output and said heater; and a controller operable to maintain the adiabatic saturation ratio and the temperature of said output air at predetermined, substantially constant levels during operation of said dryer notwithstanding changes in a parameter selected from the group consisting of said input air temperature, said input air humidity, said initially wet product moisture level and combinations thereof, by recycling a first portion of said output air stream through said recycle conduit and exhausting a second portion of said output air stream to the atmosphere, and adjusting the energy input to the dryer, said controller operable to maintain said output air stream temperature within the range of about ±10% of said predetermined level.

22. The dryer of claim 21, said range being ±2%.

* * * * *